US010337354B2

(12) United States Patent
Drake

(10) Patent No.: US 10,337,354 B2
(45) Date of Patent: Jul. 2, 2019

(54) DUAL ANTI SURGE AND ANTI ROTATION FEATURE ON FIRST VANE SUPPORT

(71) Applicant: United Technologies Corporation, Farmington, CT (US)

(72) Inventor: Christopher Drake, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 673 days.

(21) Appl. No.: 14/915,755

(22) PCT Filed: Sep. 3, 2014

(86) PCT No.: PCT/US2014/053807

§ 371 (c)(1),
(2) Date: Mar. 1, 2016

(87) PCT Pub. No.: WO2015/076896

PCT Pub. Date: May 28, 2015

(65) Prior Publication Data

US 2016/0194981 A1 Jul. 7, 2016

Related U.S. Application Data

(60) Provisional application No. 61/875,997, filed on Sep. 10, 2013.

(51) Int. Cl.
*F01D 25/28* (2006.01)
*F01D 9/02* (2006.01)
(Continued)

(52) U.S. Cl.
CPC ..... *F01D 25/28* (2013.01); *F01D 9/023* (2013.01); *F01D 9/041* (2013.01); *F01D 11/003* (2013.01);
(Continued)

(58) Field of Classification Search
CPC ..... F01D 25/28; F01D 25/243; F01D 25/246; F01D 25/24; F01D 9/023; F01D 9/041;
(Continued)

(56) References Cited

U.S. PATENT DOCUMENTS 4,016,718 A * 4/1977 Lauck ..... F01D 9/023 60/39.37
4,566,851 A * 1/1986 Comeau ..... F01D 9/042 415/115
(Continued)

FOREIGN PATENT DOCUMENTS

EP 0184975 6/1986

OTHER PUBLICATIONS

Extended European Search Report for European Application No. 14863615.2 dated Sep. 14, 2016.
(Continued)

*Primary Examiner* — Steven M Sutherland
(74) *Attorney, Agent, or Firm* — Carlson, Gaskey & Olds, P.C.

(57) ABSTRACT

A gas turbine engine includes a vane and a combustor housing that are supported relative to an engine static structure. A retaining assembly clamps the combustor housing and the vane to one another in an axial direction. A circumferential load transfer assembly circumferentially affixes the vane relative to the engine static structure. The retaining assembly is secured to the circumferential load transfer assembly.

15 Claims, 4 Drawing Sheets

(51) Int. Cl.

| | |
|---|---|
| ***F01D 9/04*** | (2006.01) |
| ***F01D 11/00*** | (2006.01) |
| ***F01D 25/24*** | (2006.01) |
| ***F23R 3/00*** | (2006.01) |

(52) U.S. Cl.
CPC ..... *F01D 25/243* (2013.01); *F01D 25/246* (2013.01); *F23R 3/002* (2013.01); *F05D 2220/32* (2013.01); *F05D 2240/35* (2013.01); *F05D 2260/30* (2013.01); *F05D 2260/36* (2013.01)

(58) Field of Classification Search
CPC ..... F01D 11/003; F23R 3/002; F23R 3/60; F05D 2260/30
See application file for complete search history.

(56) References Cited

U.S. PATENT DOCUMENTS

| | | | | |
|---|---|---|---|---|
| 4,785,623 | A | 11/1988 | Reynolds | |
| 5,289,677 | A | 3/1994 | Jarrell | |
| 5,785,492 | A | 7/1998 | Belsom et al. | |
| 6,347,508 | B1 * | 2/2002 | Smallwood | F01D 9/023 60/796 |
| 7,237,388 | B2 | 7/2007 | Aumont et al. | |
| 8,206,096 | B2 | 6/2012 | Prentice et al. | |
| 2008/0008584 | A1 | 1/2008 | Shteyman et al. | |
| 2009/0155069 | A1 | 6/2009 | Druocher et al. | |
| 2010/0183436 | A1 * | 7/2010 | Kasperski | F01D 9/04 415/220 |
| 2013/0174557 | A1 | 7/2013 | Spooner | |

OTHER PUBLICATIONS

Extended European Search Report for European Application No. 17201018.3 dated Jan. 31, 2018.
International Search Report and Written Opinion for PCT/US2014/053807 dated Jun. 16, 2015.
International Preliminary Report on Patentability for PCT Application No. PCT/US2014/053807 dated Mar. 24, 2016.

* cited by examiner

DUAL ANTI SURGE AND ANTI ROTATION FEATURE ON FIRST VANE SUPPORT

CROSS-REFERENCE TO RELATED APPLICATIONS

This application claims priority to U.S. Provisional Application No. 61/875,997, which was filed on Sep. 10, 2013.

STATEMENT REGARDING FEDERALLY SPONSORED RESEARCH OR DEVELOPMENT

This invention was made with government support under Contract No. FA8650-09-D-29230021 awarded by the United States Air Force. The Government has certain rights in this invention.

BACKGROUND

This disclosure relates to first stage turbine vanes and associated mounting arrangement.

A gas turbine engine typically includes a fan section, a compressor section, a combustor section and a turbine section. Core flow air entering the compressor section is compressed and delivered into the combustion section where it is mixed with fuel and ignited to generate a high-speed exhaust gas flow. The combustor section includes a combustor housing with a flange used to mount the combustor housing with respect to the engine's static structure. The high-speed exhaust gas flow expands through the turbine section to drive the compressor and the fan section.

First stage turbine vanes are arranged immediately downstream from the combustor section to efficiently communicate the core flow into the first stage of turbine blades. Prior technology for the first stage turbine vanes employs two separate features to complete two separate tasks, affixing the vanes circumferentially and supporting the combustor in the event of a compressor surge condition.

Typically an array of separate vanes or clusters of vanes are mounted with respect to the engines static structure. The engine static structure includes a circumferential load transfer assembly having a circumferential array of tabs, which are used to interface with a fork on each of the first vanes to affix the vanes circumferentially. The engine static structure also includes a boss separate from the tabs to which a retainer is bolted to provide a retaining assembly. The retaining assembly secures the combustor flange to the engine static structure via the vanes and holds the flange in place in case of a compressor surge condition. These two features are separate from one another and located circumferentially between each other around the engine static structure.

SUMMARY

In one exemplary embodiment, a gas turbine engine includes a vane and a combustor housing that are supported relative to an engine static structure. A retaining assembly clamps the combustor housing and the vane to one another in an axial direction. A circumferential load transfer assembly circumferentially affixes the vane relative to the engine static structure. The retaining assembly is secured to the circumferential load transfer assembly.

In a further embodiment of the above, the engine static structure includes a vane support. The vane support includes one of a tab and a fork. The vane includes the other of the tab and the fork. The tab is received in the fork. The tab and the fork provide the circumferential load transfer assembly.

In a further embodiment of any of the above, the fork is provided on an outer platform of the vane. The tab is provided on the vane support.

In a further embodiment of any of the above, the retainer assembly includes a retainer secured to the tab. The combustor housing is arranged axially between the retainer and the vane.

In a further embodiment of any of the above, a seal ring is engaged between the combustor housing and the vane.

In a further embodiment of any of the above, the retainer includes a finger. The combustor housing includes an annular protrusion that extends radially outward from the combustor housing. The finger engages the annular protrusion.

In a further embodiment of any of the above, the combustor housing includes an edge that engages the seal ring.

In a further embodiment of any of the above, the retainer and tab include holes. A fastener extends through the holes to secure the retainer to the vane support.

In a further embodiment of any of the above, there is a circumferential array of a number of vanes. Each vane includes a fork and a number of tabs with holes being less than the number of vanes.

In a further embodiment of any of the above, the retaining assembly is provided by discrete retainers circumferentially spaced from one another.

In a further embodiment of any of the above, the retaining assembly is provided by an annular ring that is secured to multiple tabs.

In a further embodiment of any of the above, the annular ring includes lightening holes.

In another exemplary embodiment, a gas turbine engine includes an engine static structure that includes a vane support having a tab. A vane includes a fork that has a notch that receives the tab to circumferentially affix the vane to the engine static structure. A retainer is secured to the tab and mounts a combustor housing to the vane in an axial direction.

In a further embodiment of the above, a seal ring is engaged between the combustor housing and the vane.

In a further embodiment of any of the above, the retainer includes a finger. The combustor housing includes an annular protrusion that extends radially outward from the combustor housing. The finger engages the annular protrusion.

In a further embodiment of any of the above, the combustor housing includes an edge that engages the seal ring.

In a further embodiment of any of the above, the retainer and tab include holes. A fastener extends through the holes to secure the retainer to the vane support.

In a further embodiment of any of the above, there is a circumferential array of a number of vanes. Each vane includes a fork and a number of tabs with holes being less than the number of vanes.

In a further embodiment of any of the above, discrete retainers are circumferentially spaced from one another.

In a further embodiment of any of the above, the retainer is provided by an annular ring secured to multiple tabs.

BRIEF DESCRIPTION OF THE DRAWINGS

The disclosure can be further understood by reference to the following detailed description when considered in connection with the accompanying drawings wherein.

DETAILED DESCRIPTION

Figure 1:
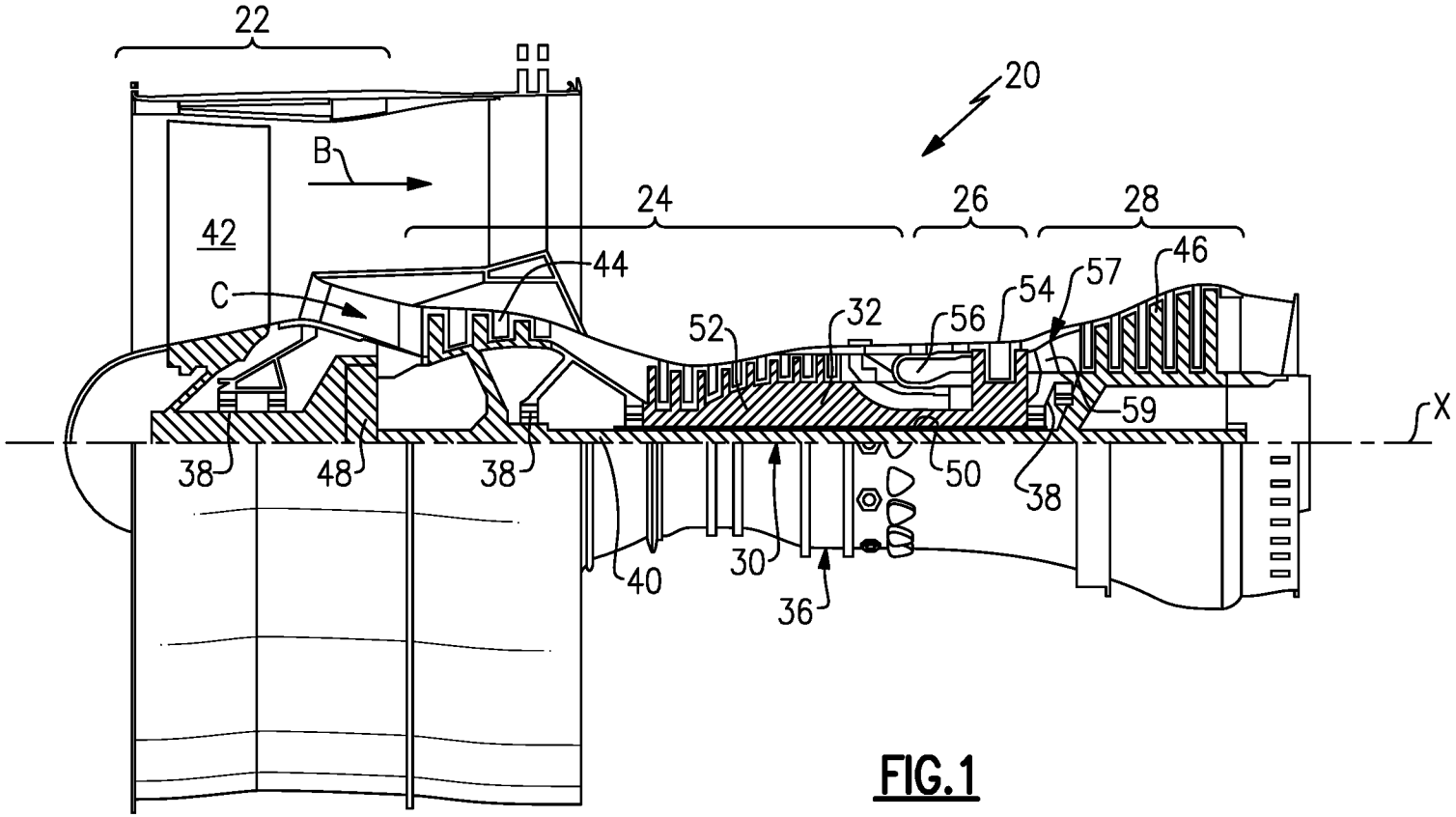
FIG. 1 is a schematic view of an example gas turbine engine including a combustor section.

FIG. 1 schematically illustrates a gas turbine engine 20. Although commercial engine embodiment is shown, the disclosed vane mounting arrangement may also be used in military engine applications. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features.

Figure 2:
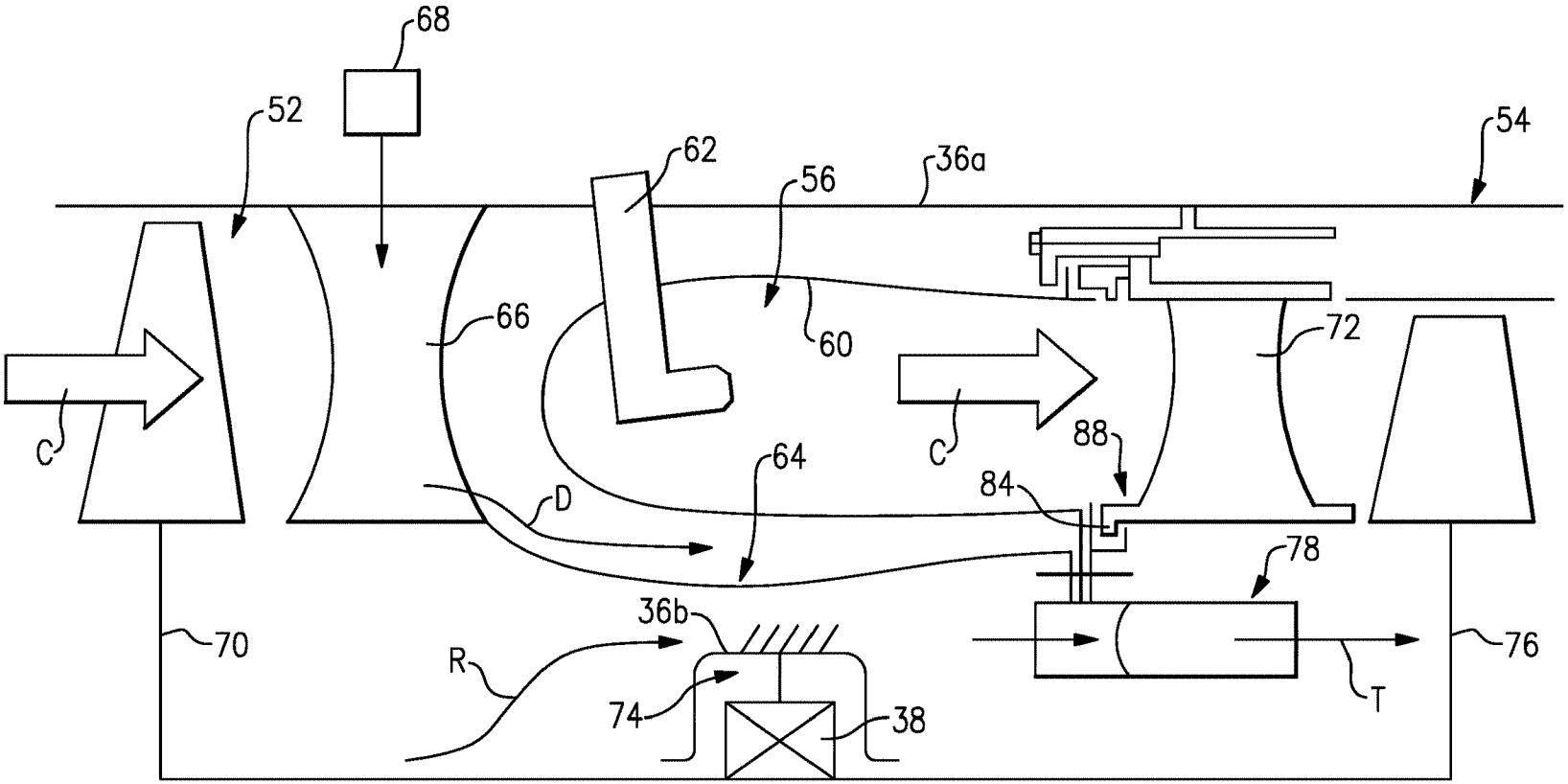
FIG. 2 is a schematic view of the combustor section.

The fan section 22 drives air along a bypass flowpath B while the compressor section 24 drives air along a core flowpath C (as shown in FIG. 2) for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes.

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

An area of the combustor section 26 is shown in more detail in FIG. 2. The combustor section 26 includes a combustor 56 having a combustor housing 60. An injector 62 is arranged at a forward end of the combustor housing 60 and is configured to provide fuel to the combustor housing 60 where it is ignited to produce hot gases that expand through the turbine section 54.

A diffuser case 64 is secured to the combustor housing 60 and forms a diffuser plenum surrounding the combustor housing 60. The diffuser plenum may receive a diffuser flow D for diffusing flow from the compressor section 52 into the combustor section 56. The diffuser case 64 and the combustor housing 60 are fixed relative to the engine static structure 36 (FIG. 1), illustrated as elements 36*a* and 36*b* in FIG. 2.

Figure 4A:
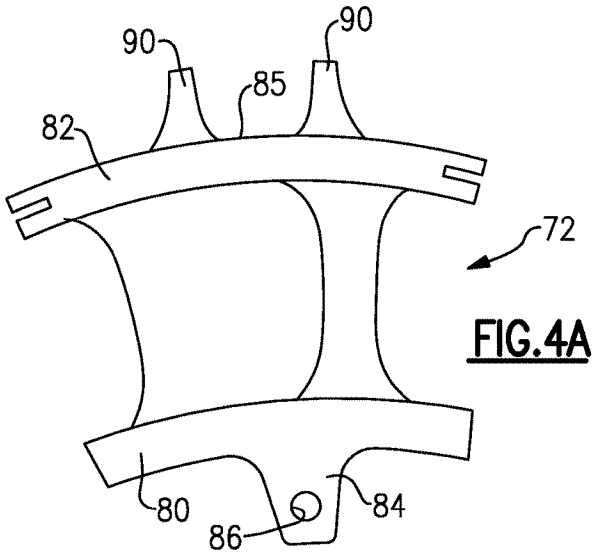
FIG. 4A is a front elevational view of an example turbine vane shown in FIG. 3A.
Figure 4B:
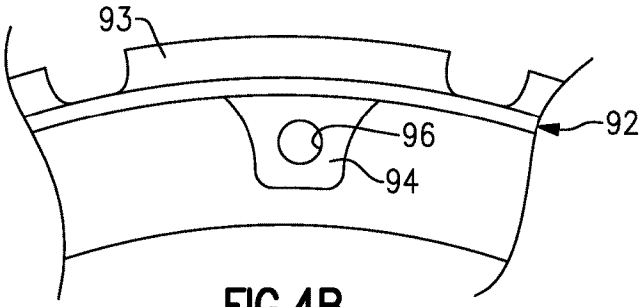
FIG. 4B is an enlarged view of the vane support shown in FIG. 3A.
Figure 3A:
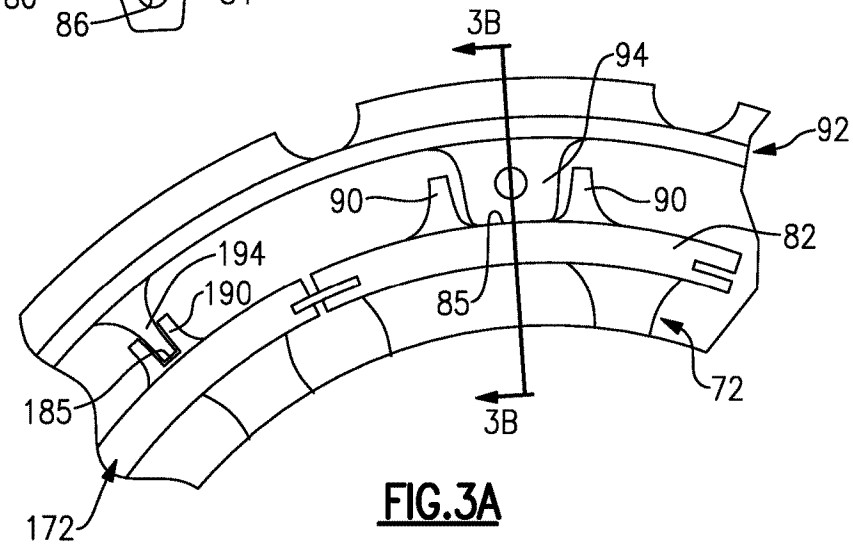
FIG. 3A illustrates an example first stage turbine vane supported relative to engine static structure, which includes a vane support.
Figure 3B:
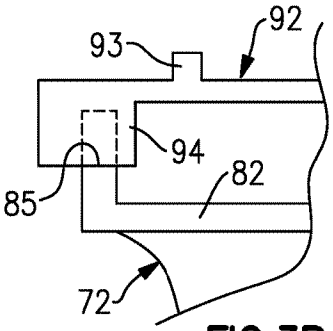
FIG. 3B is a cross-sectional view of the assembly shown in FIG. 3A and taken along line 3B-3B.

In one example, an array of vanes 72 of a first stage of turbine stator vanes includes an inner portion that is partially supported by the diffuser case 64. One typical mounting method for first stage turbine vanes is to provide a radially inwardly extending flange 84 that includes a hole 86 (shown in FIG. 4A). A pin (not shown) is received in the hole to secure the flange 84 at a joint 88 (shown in FIG. 2).

With continuing reference to FIG. 2, the diffuser case 64 includes a portion arranged downstream from the compressor section 52 and upstream from the combustor section 26 that is sometimes referred to as a "pre-diffuser" 66. A bleed source 68, such as fluid from a compressor stage, provides cooling fluid through the pre-diffuser 66 to various locations interiorly of the diffuser case 64. A heat exchanger (not shown) may be used to cool the cooling fluid before entering the pre-diffuser 66.

The compressor section 52 includes a compressor rotor 70 supported for rotation relative to the engine static structure 36*b* by the bearing 38. The bearing 38 is arranged within a bearing compartment 74 that is buffered using a buffer flow R. The turbine section 54 includes a turbine rotor 76 arranged downstream from a tangential on-board injector module 78, or "TOBI." The TOBI 78 provides cooling flow T to the turbine rotor 76.

Referring to FIGS. 3A-4B, the vanes 72 include an outer portion that is supported by the engine static structure 36*a* using a vane support 92, which is provided by a unitary annular structure, however, it should be understood that the vane support 92 may instead be constructed from multiple segments. In one example, the vane support 92 is grounded to an outer case of the engine static structure using teeth 93. The vanes 72 may be provided as multiple arcuate segments. In one example, each vane 72 is provided a doublet having a pair of airfoils joined between radially spaced apart inner and outer platforms 80, 82.

The outer platform 82 includes radially extending circumferentially spaced structures providing a fork 90 that defines a notch 85. The vane support 92 includes a radially inwardly extending tab 94 that is received circumferentially within the fork 90 in the notch 85 to provide a circumferential load transfer assembly. In one example, at least one fork is provided on each vane. This fork and tab arrangement circumferentially locates the vanes 72 and transfers the circumferential load from the vanes 72 during engine operation to the engine static structure 36*a* via the vane support 92.

Figure 5:
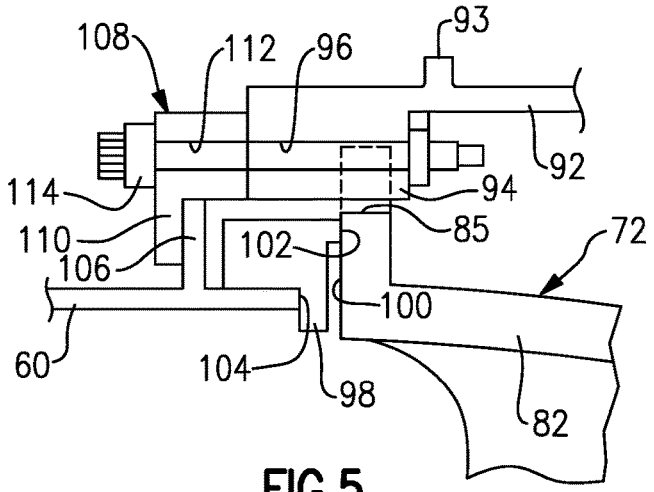
FIG. 5 is a cross-sectional view of a retainer assembly used to support a combustor housing and the turbine vanes relative to the engine static structure.
Figure 6:
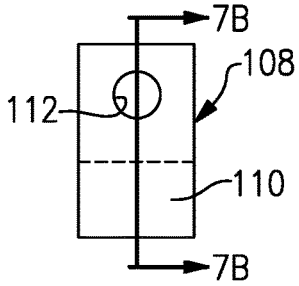
FIG. 6 is a front elevational view of an example retainer.

Referring to FIGS. 5 and 6, the tab 94 includes a hole 96 to which a retainer 108 is secured to provide a retaining assembly. In one example, up to twenty retaining assemblies may be provided circumferentially, which may be less than the number of vanes 72. The retaining assembly clamps the combustor housing 60 to the vane 72 and holds the assembly together, in particular, during compressor surge conditions.

In one example, a ring seal 98 is arranged axially between an aft end of the combustor housing 60 and a forward face 100 of the outer platform 82. An edge 104 of the combustor housing 60 urges a sealing face 102 of the ring seal 98 into engagement with the forward face 100. A radially inwardly extending finger 110 of the retainer 108 engages an annular protrusion 106 that extends radially outwardly from the combustor housing 60. A fastener 114 received in the hole 96 and a hole 112 in the retainer 108 is used to apply a clamping load to seal the combustor 60 relative to the vane 72.

For vanes 172 (FIG. 3A) that do not have a retaining assembly, for example, tabs 194, which without a hole 95 to accommodate the retainer 108, the fork 190 and its notch 185 may be narrower since there is no need to accommodate a fastener through the tab.

Figure 7A:
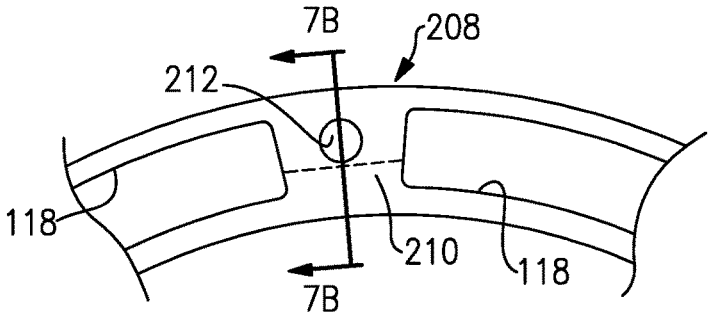
FIG. 7A is a front elevational view of another example retainer.
Figure 7B:
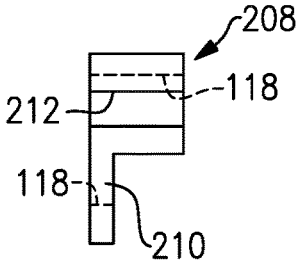
FIG. 7B is a cross-sectional view of the retainer shown in FIG. 7A and taken along line 7B-7B.

Another example retainer 208 is illustrated in FIG. 7A-7B. Unlike the discrete retainer 108 illustrated in FIGS. 5 and 6, the retainer 208 may be a continuous annular ring or arcuate segments that provide multiple of fingers 210. Lightning holes 118 may be provided on the ring to reduce the weight of the retainer 208.

The retaining assembly is secured to the circumferential load transfer assembly. Integrating the retaining assembly with the circumferential load transfer assembly provides a significant weight savings. The disclosed arrangement uses a single bolted on feature at several circumferential locations, which prevents circumferential movement of the vanes and prevents the combustor from moving forward in a surge condition.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

a vane and a combustor housing supported relative to an engine static structure;

a retaining assembly clamping the combustor housing and the vane to one another in an axial direction; and a circumferential load transfer assembly circumferentially affixing the vane relative to the engine static structure, the retaining assembly secured to the circumferential load transfer assembly, wherein the engine static structure includes a vane support, the vane support including one of a tab and a fork, and the vane including the other of the tab and the fork, the tab received in the fork, and the tab and the fork providing the circumferential load transfer assembly, wherein the retainer assembly includes a retainer secured to the tab, and the combustor housing arranged axially between the retainer and the vane.

2. The gas turbine engine according to claim 1, comprising a seal ring engaged between the combustor housing and the vane.

3. The gas turbine engine according to claim 2, wherein the retainer includes a finger, the combustor housing includes an annular protrusion extending radially outward from the combustor housing, the finger engaging the annular protrusion.

4. The gas turbine engine according to claim 3, wherein the combustor housing includes an edge engaging the seal ring.

5. The gas turbine engine according to claim 1, wherein the retainer and tab include holes, and a fastener extends through the holes to secure the retainer to the vane support.

6. The gas turbine engine according to claim 5, comprising a circumferential array of a number of vanes, each vane including a fork, and a number of tabs with holes, the number of tabs being less than the number of vanes.

7. The gas turbine engine according to claim 1, wherein the retaining assembly is provided by discrete retainers circumferentially spaced from one another.

8. The gas turbine engine according to claim 1, wherein the retaining assembly is provided by an annular ring secured to multiple tabs.

9. The gas turbine engine according to claim 8, wherein the annular ring includes lightening holes.

10. The gas turbine engine according to claim 1, comprising discrete retainers circumferentially spaced from one another.

11. The gas turbine engine according to claim 1, wherein the retainer is provided by an annular ring secured to multiple tabs.

12. A gas turbine engine comprising:

an engine static structure including a vane support having a tab;

a vane including a fork having a notch receiving the tab to circumferentially affix the vane to the engine static structure; and a retainer secured to the tab and mounting a combustor housing to the vane in an axial direction, wherein the retainer includes a finger, the combustor housing includes an annular protrusion extending radially outward from the combustor housing, the finger engaging the annular protrusion.

13. The gas turbine engine according to claim 12, comprising a seal ring engaged between the combustor housing and the vane, wherein the combustor housing includes an edge engaging the seal ring.

14. A gas turbine engine comprising:

an engine static structure including a vane support having a tab;

a vane including a fork having a notch receiving the tab to circumferentially affix the vane to the engine static structure; and a retainer secured to the tab and mounting a combustor housing to the vane in an axial direction, wherein the retainer and tab include holes, and a fastener extends through the holes to secure the retainer to the vane support.

15. The gas turbine engine according to claim 14, comprising a circumferential array of a number of vanes, each vane including a fork, and a number of tabs with holes, the number of tabs being less than the number of vanes.

* * * * *